US012146715B2

(12) United States Patent
Runk

(10) Patent No.: US 12,146,715 B2
(45) Date of Patent: Nov. 19, 2024

(54) HOLDING SUPPORT AND V-SHAPED HEAT EXCHANGER HAVING THE SAME

(71) Applicant: MAHLE International GmbH, Stuttgart (DE)

(72) Inventor: Robert Louis Runk, Lockport, NY (US)

(73) Assignee: MAHLE International GmbH, Stuttgart (DE)

( * ) Notice: Subject to any disclaimer, the term of this patent is extended or adjusted under 35 U.S.C. 154(b) by 385 days.

(21) Appl. No.: 17/558,676

(22) Filed: Dec. 22, 2021

(65) Prior Publication Data

US 2023/0194190 A1 Jun. 22, 2023

(51) Int. Cl.
*F28F 9/013* (2006.01)
*F28F 9/00* (2006.01)

(52) U.S. Cl.
CPC ..... *F28F 9/0131* (2013.01); *F28F 9/002* (2013.01); *F28F 2275/08* (2013.01); *F28F 2280/08* (2013.01)

(58) Field of Classification Search
CPC ..... F24F 9/0131; F28F 2275/08; F28F 2275/085; B60H 1/3233
See application file for complete search history.

(56) References Cited

U.S. PATENT DOCUMENTS 3,000,193 A * 9/1961 Crider ..... F24F 5/001 62/449
2005/0000242 A1* 1/2005 Kucera ..... F24F 5/0035 62/310
2005/0029371 A1* 2/2005 Kucera ..... F24F 1/0007 239/593
2007/0169497 A1* 7/2007 Rios ..... F28F 17/005 62/286
2009/0151384 A1* 6/2009 Lee ..... B60H 1/3233 62/285
2018/0340706 A1* 11/2018 Amick ..... F24F 13/20
2022/0235980 A1* 7/2022 Mercer ..... F25B 39/02
2023/0194190 A1* 6/2023 Runk ..... F28D 1/0471 165/80.1

FOREIGN PATENT DOCUMENTS

DE 102012017039 A1 * 3/2014 ..... F28D 1/0472
EP 2884209 A1 6/2015
GB 2536673 A * 9/2016 ..... B60H 1/3233
JP H0527522 U * 4/1993
JP 2008070102 A * 3/2008
JP 2010117064 A * 5/2010
JP 2016090162 A * 5/2016
JP 2016133284 A * 7/2016

OTHER PUBLICATIONS

Translation of JPH0527522U named Translation-JPH0527522U (Year: 2024).*

* cited by examiner

*Primary Examiner* — Paul Alvare
(74) *Attorney, Agent, or Firm* — Dickinson Wright PLLC

(57) ABSTRACT

A holding support for a v-shaped heat exchanger having a flat base plate, which on a plate edge forms a spreading finger holder with holding fingers for holding flat tubes of the v-shaped heat exchanger and on a further plate edge forms a support for supporting the holding support. In a v-shaped heat exchanger two holding supports may be used to support the v-shaped heat exchanger on a surface.

12 Claims, 3 Drawing Sheets

HOLDING SUPPORT AND V-SHAPED HEAT EXCHANGER HAVING THE SAME

FIELD

This disclosure relates generally to a holding support for use in a v-shaped heat exchanger, as well as a v-shaped heat exchanger having such holding supports.

BACKGROUND

The statements in this section merely provide background information related to the present disclosure and may not constitute prior art.

Known v-shaped heat exchangers, such as the heat exchanger described in EP 2 884 209 B1, are directly placed on a surface, wherein its cooling fin-free bent flat tube portions frequently come into contact with dirt and moisture, e.g., condensate. Due to this exposure, cumulated signs of corrosion normally occur on the bent flat tube portions that are free of cooling fins. The occurrence of this corrosion disadvantageously influences the lifespan of the v-shaped heat exchanger and/or at least renders more frequent maintenance intervals necessary.

SUMMARY

The present disclosure generally provides a holding support for a v-shaped heat exchanger. The holding support comprises a flat base plate which includes or forms on a plate edge a spreading finger holder comprising holding fingers for holding flat tubes of a v-shaped heat exchanger and on a further plate edge a support for supporting the holding support. One or more of the holding fingers may be bent over with respect to the base plate.

According to one aspect of the present disclosure, the holding fingers may comprise first and second holding fingers, such that at least one first holding finger is bent over with respect to the base plate at a folding region of the plate edge, while at least one second holding finger is embodied flat with respect to the base plate (3). Between the first holding fingers and the second holding fingers, a mounting receptacle of the spreading finger holder for receiving flat tubes of a v-shaped heat exchanger is delimited or formed. At least one first holding finger and at least one second holding finger define a 45° to 120° angle between them. At least one first holding finger and at least one second holding finger may be arranged along the plate edge in series with one another or in an alternating order.

According to another aspect of the present disclosure, at least one first holding finger and at least one second holding finger on or in the region of the plate edge of the base plate are directly adjacent in a plate direction defined by the plate edge with respect to one another or subject to the interposing of a gap, and/or two first holding fingers are adjacent in a plate direction defined by the plate edge subject to the interposing of a receiving gap. At least one first holding finger and at least one second holding finger each project away from the base plate in the direction of a finger direction standing perpendicularly on a plate direction defined by the plate edge. When desirable, at least one first holding finger and at least one second holding finger may be integrally formed with the base plate. At least one first holding finger is embodied identical in length or shorter than at least one second holding finger.

According to another aspect of the present disclosure, the one plate edge and the further plate edge are arranged on sides of the base plate that are opposite to one another and/or are configured parallel to one another, and/or the support is realized by a base plate narrow surface of the base plate defined by the further plate edge.

According to another aspect of the present disclosure, on the base plate at least one mounting tab is arranged, which is equipped for supporting a further holding support and bent over with respect to the base plate. When desirable at least one drainage recess may be arranged on the base plate. At least the base plate is produced out of an aluminum material, a plastic material, a composite material, or a combination thereof.

According to yet another aspect of the present disclosure, a v-shaped heat exchanger comprises: a first fluid collector and a second fluid collector, which are fluidically coupled to one another via flat tubes, so that a fluid can flow from the first fluid collector to the second fluid collector and vice versa; at least two holding supports as described above and further defined herein, and a collecting pan for collecting condensate. The flat tubes comprise a first straight flat tube portion, a second straight tube portion, and a bent flat tube portion fluidically arranged between the first and second straight flat tube portions. Between adjacent flat tubes of the first straight flat tube portion, cooling fins configured for cooling air to be circulated about are arranged. Similarly, between adjacent flat tubes of the second straight flat tube portion, cooling fins configured for cooling air to be circulated about are arranged. The bent flat tube portion is cooling fin-free. The holding supports with their spreading finger holders are arranged on two outer large sides of the v-shaped heat that are oriented opposite to one another and inclined relative to one another so that their first holding fingers are each inserted on the bent flat tube portion between two adjacent flat tubes and their second holding fingers are each touchingly supported on the flat tubes on the bent flat tube portion and/or on one of the first or second straight flat tube portions. The first holding fingers and the second holding fingers of the two holding supports may be soldered in an integrally bonded manner or fixed in a positive or non-positive manner to the flat tubes. An integral unit formed out of the flat tubes, the two fluid collectors and the two holding supports is exclusively supported on the collecting pan by way of the two holding supports.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, which are provided as a schematic representations.

Figure 1:
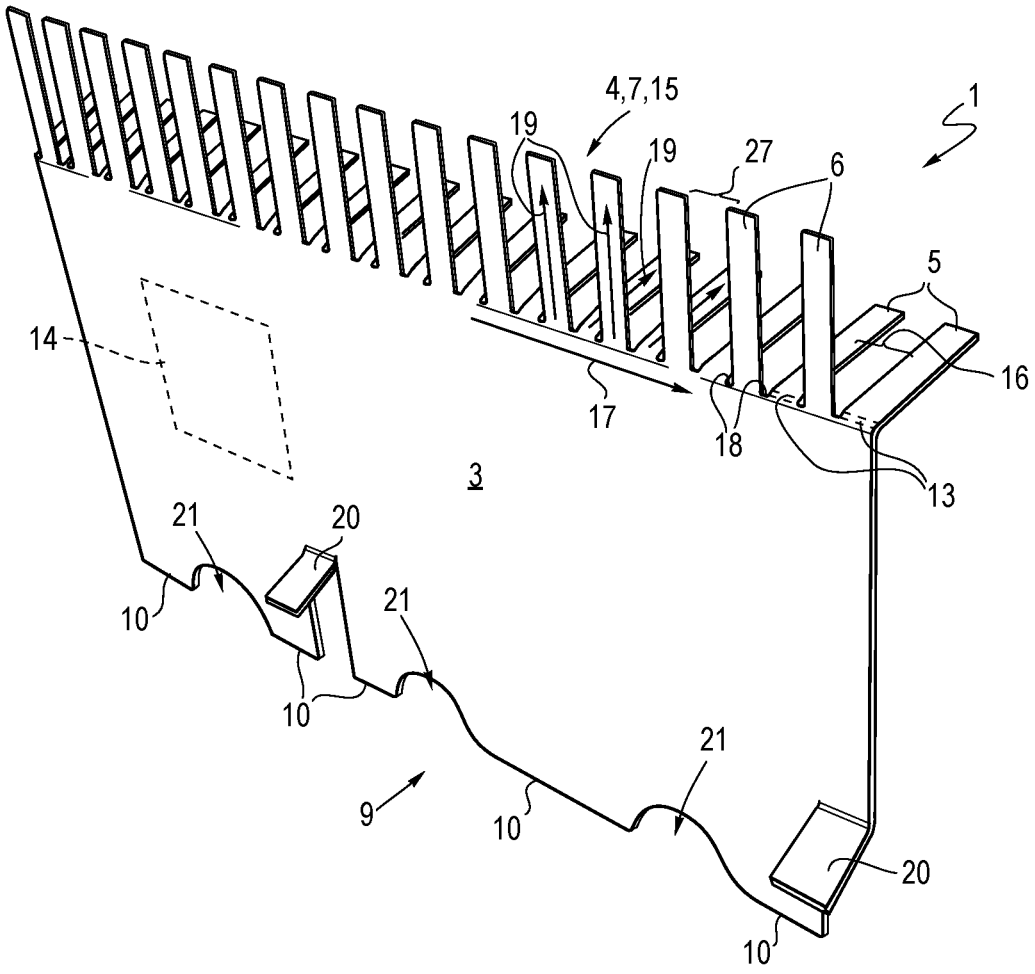
FIG. 1 is a perspective view of a holding support according to teachings of the present disclosure.

The drawings described herein are for illustration purposes only and are not intended to limit the scope of the present disclosure in any way. Various embodiments of the present disclosure are shown in the drawings and will be explained in more detail in the following description, wherein like reference signs refer to like or similar or functionally identical components or features.

DETAILED DESCRIPTION

The following description is merely exemplary in nature and is in no way intended to limit the present disclosure or its application or uses. For example, the holding support made and used according to the teachings contained herein are described throughout the present disclosure in conjunction with a bent tube or coiled heat exchanger used in an air conditioner system in order to more fully illustrate the construction and the use thereof. The incorporation and use of such holding supports in other heating, ventilation, air conditioning, and refrigeration applications wherein a bent tube or coiled heat exchanger would be desirable is contemplated not to exceed the scope of the present disclosure.

For the purpose of this disclosure, the terms "at least one" and "one or more of" an element are used interchangeably and may have the same meaning. These terms, which refer to the inclusion of a single element or a plurality of the elements, may also be represented by the suffix "(s)" at the end of the element. For example, "at least one fin", "one or more fins", and "fin(s)" may be used interchangeably and are intended to have the same meaning.

For the purpose of this disclosure, the terms "about" and "substantially" are used herein with respect to measurable values and ranges due to expected variations known to those skilled in the art (e.g., limitations and variability in measurements).

Although specific terminology is used herein to describe particular embodiments within the disclosure, this terminology is not intended to limit any portion of the disclosure. For example, as used herein, singular forms of "a", "an", and "the" are intended to include various plural forms as well, unless the context of their use clearly indicates otherwise. Terms, such as "comprises", "includes", "comprising" or "including" are meant to specify the presence of stated features, integers, steps, operations, elements, and/or components, but are not meant to preclude the presence and/or addition of one or more other features, integers, steps, operations, elements, components, and/or groups associated therewith.

The present disclosure addresses the deficiency of the prior art by providing a design for a v-shaped heat exchanger having one or more holding supports that provide an improvement over or at least an alternative embodiment for a v-shaped heat exchanger of the generic type, in which the disadvantages described are overcome. The present disclosure practically relates to a holding support for a v-shaped heat exchanger having a flat base plate, which on a plate edge comprises or forms a spreading finger holder comprising holding fingers for holding flat tubes of a v-shaped heat exchanger and on a further plate edge a support for supporting the holding support. The present disclosure also relates to a v-shaped heat exchanger having two holding supports for supporting the v-shaped heat exchanger on a surface.

The present disclosure is generally based on supporting a v-shaped heat exchanger on a surface by means of at least one holding support, so that the surface and v-shaped heat exchanger are contact-free. For this purpose, a holding support for a v-shaped heat exchanger is provided with a flat base plate, which on a plate edge comprises or forms a spreading finger holder comprising holding fingers for holding flat tubes of a v-shaped heat exchanger and on a further plate edge a support for supporting the holding support, practically on a surface, such as a collecting pan for collecting and conducting condensate. The holding support according to the invention can be mounted from the outside to a straight leg of a v-shaped heat exchanger, for example soldered or screwed, wherein the spreading finger holder with its holding fingers engages about flat tubes of the v-shaped heat exchanger so that the holding support is held on the heat exchanger. The support of the holding support according to one aspect of the present disclosure is practically placed on a surface, so that the v-shaped heat exchanger is supportable on the surface via the holding support. The support can be arranged on a side of the base plate spaced apart from the spreading finger holder, for example the plate edge and the further plate edge form plate edges of the base plate that are opposite to one another. In this manner, the v-shaped heat exchanger can on the one hand be relatively easily placed onto a surface while on the other hand it can be ensured that merely the support of the holding support formed according to the disclosure, but not the v-shaped heat exchanger per se, will come into contact with the surface. This has the advantageous effect that moisture and dirt do not come into contact with the v-shaped heat exchanger as a result of which signs of corrosion and dirt on the v-shaped heat exchanger, in particular on its cooling fin-free, bent flat tube portion, are efficiently prevented.

According to another aspect of the present disclosure at least one holding finger of the total number of holding fingers present in the spreading finger holder may be bent over with respect to the base plate. Because of this, a spreading finger holder can be realised in a simple and cost-effective manner. One practical example of such a spreading finger holder includes, without limitation, each second or each third holding finger of the total number of holding fingers in the spreading finger holder being bent over with respect to the base plate.

According to another aspect of the present disclosure, at least one first holding finger of the holding fingers may be bent over with respect to the base plate at a folding region of the plate edge, while at least one second holding finger of the holding fingers is embodied flat, i.e. is not bent over with respect to the base plate. In this case, the at least one second holding finger lies in a base plane defined by the base plate, while the at least one first holding finger is inclined with respect to the base plane. Here, a mounting receptacle of the spreading finger holder for receiving flat tubes of a v-shaped heat exchanger, in particular a mounting receptacle configured triangularly prismatic in shape, can be delimited or formed between the first holding fingers and the second holding fingers of the base plate. By way of this, a spreading finger holder can also be realised in a simple and cost-effective manner. When the holding fingers are integrally formed by the base plate, merely only one retaining finger has to be bent over with respect to the base plate for realizing the spreading finger holder, while the other ones can remain in the base plane unchanged.

According to another aspect of the present disclosure, all holding fingers may be bent over with respect to the base plate at least at one folding region, but the at least one first holding finger in a first inclination (bending angle) with respect to the base plate and the at least one second holding finger in a second inclination (bending angle) deviating from the first inclination. In other words, at least one first holding finger of the holding fingers is bent over with respect to the base plate at a folding region of the plate edge and also at least one second holding finger of the holding fingers is bent over at with respect to the base plate at a folding region of the plate edge, in the manner that between the at least one first holding finger and the at least one second holding finger a mounting receptacle of the spreading finger holder for receiving flat tubes of a v-shaped heat exchanger, such as a mounting receptacle configured triangularly prismatic in shape, is delimited or formed. By way of this, the holding support or the spreading finger holder of the same, can be adapted to any specific design circumstances or considerations for a v-shaped heat exchanger.

According to another aspect of the present disclosure at least one first holding finger and at least one second holding finger define an angle between them. This angle generally lies in an angular range between 45° to 120°, alternatively, between 90° to 120°.

According to another aspect of the present disclosure, at least one first holding finger and at least one second holding finger may be arranged along the plate edge, which can be configured straight or bent, in series with one another. This means that the holding fingers fringe or border the plate edge in the manner that resembles how a carpet fringe is located approximate to a carpet's edge. The holding fingers are evenly arranged on the plate edge and can furthermore be arranged on the plate edge either distributed over the entire length of the plate edge or at least on a portion of the plate edge. The holding fingers may be arranged in series with one another even when the one or other holding finger is bent over.

According to another aspect of the present disclosure, the first holding fingers and the second holding fingers of the base plate may be arranged along the plate edge that is practically embodied straight or bent in an alternating order. Because of this-always alternating-a holding finger is embodied flat with the base plate and a further holding finger, such as a directly adjacent holding finger, is embodied bent over. Because of this, a holding support is described, whose spreading finger holder is excellently suited for holding a v-shaped heat exchanger.

According to another aspect of the present disclosure, at least one first holding finger or the folding region of at least one first holding finger and at least one second holding finger on the plate edge or in the region of the plate edge of the base plate in a plate direction defined by the plate edge may be directly adjacent to one another or subject to the interposing of a gap. In this case, a correspondingly configured holding support can be easily produced. The holding fingers, which have to be bent over with respect to the base plate, can be bent over with a single tool and in one operating step. In addition, two first holding fingers that are adjacent in a plate direction may be defined by the plate edge by way of a receiving gap. This receiving gap may be wider than the gap because the receiving gap is formed or opened by the bending-over of a second holding finger arranged between the first holding fingers.

According to another aspect of the present disclosure, at least one first holding finger and at least one second holding finger each may project away from the base plate in the direction of a finger direction standing perpendicularly on a plate direction defined by the plate edge. In this case, the holding fingers project quasi-perpendicularly with respect to the plate edge away from the base plate.

According to another aspect of the present disclosure, the holding fingers, i.e. the at least one first holding finger and the at least one second holding finger, seen by themselves, are embodied flat and straight so that they do not comprise any bends whatsoever. However it is conceivable without exceeding the scope of the present disclosure that the holding fingers, i.e. the at least one first holding finger and the at least one second holding finger, seen by themselves, may be configured curved or angularly and/or comprise a recess for providing further functions.

According to yet another aspect of the present disclosure, at least one first holding finger and at least one second holding finger may be integrally formed with the base plate. In this case, the holding support can be produced cost-effectively because the holding fingers merely have to be formed out of a raw plate component that also acts as the base plate. The holding fingers may formed by being punched out, stamped, or similar method, for example, without limitation, and the one or other holding fingers subsequently bent over. One skilled in the art will understand that it is conceivable that the holding fingers with respect to the base plate may be originally separate parts, which are subsequently joined to the base plate without exceeding the scope of the present disclosure.

According to another aspect of the present disclosure, at least one first holding finger, such as in the direction of a finger direction defined by its main extension, is embodied identical in length or shorter than at least one second holding finger. This can promote a secure holding of the v-shaped heat exchanger in the spreading finger holder. Apart from this, the total weight of the holding support can be reduced by a shortening of at least one first holding finger, so that a relatively light-weight design solution for a holding support is provided.

According to another aspect of the present disclosure, the one plate edge and the further plate edge of the base plate may be arranged on sides of the base plate that are opposite to one another and/or are configured parallel to one another. Furthermore, it can be provided that the support may be realised by the narrow surface of the base plate defined by the further plate edge. Because of this, the v-shaped heat exchanger may be relatively easily placed on a surface. In addition, it can be ensured that merely the support of the holding support, but not the v-shaped heat exchanger, will come into contact with the surface. This has the advantage that moisture and dirt from the surface does not come into contact with the v-shaped heat exchanger. As a result, the occurrence of corrosion and/or dirt build-up on the v-shaped heat exchanger can be efficiently prevented.

The plate edge and the further plate edge describe between them a distance that can be adjusted by varying the dimensions of the base plate. In principle a relatively large distance between the plate edge and the further plate edge, i.e. when the base plate is dimensioned relatively large, generates a likewise relatively large distance between the v-shaped heat exchanger and a surface, and vice versa.

According to another aspect of the present disclosure, at least one mounting tab may be arranged on the base plate. This mounting tab is equipped for supporting a further holding support and bent over with respect to the base plate. The at least one mounting tab may be embodied integrally with the base plate and define an angle between it and the base plate (or the base plane) in an angular range between 0° to 90°, alternatively, in an angular range between 0° to 60°. Between at least one mounting tab and at least one (first) holding finger bent over with respect to the base plate, an angle can be defined which lies in an angular range between 90° to 270°, alternatively, in an angular range between 135° to 225°. Because of this, the at least one mounting tab protrudes over a first large surface of the base plate, while the at least one (first) holding finger bent over with respect to the base plate protrudes over a second large surface of the base plate that is opposite with respect to the first large surface.

Starting out from the further plate edge of the base plate, at least one mounting tab can be formed in a manner similar to that used to introduce the two adjacent slits, which are oriented orthogonally to the further plate edge, into the base plate, so that between the two slits a mounting tab is delimited, which still has to be manually or mechanically bent over with respect to the base plate. At least one mounting tab is provided for the purpose of providing, as part of the mounting of the holding support to a heat exchanger, a support for an additional holding support likewise to be mounted to the heat exchanger. However, in this case, it is conceivable that at least one mounting tab may be originally a separate part with respect to the base plate, which is subsequently joined to the base plate.

According to another aspect of the present disclosure, at least one drainage recess may be arranged on the base plate. In this case, at least one drainage recess is equipped for conducting condensate. The at least one drainage recess may be assigned to the further plate edge of the base plate. Because of this, the at least one drainage recess can, when the holding support is mounted to a v-shaped heat exchanger and placed on a surface, be directly arranged on the surface in order to form or delimit together with the surface a kind of a conduit for condensate to flow. The at least one drainage recess may have a semi-circular or round contour. In addition, the surface may be realised in particular by a collecting pan or the like.

The holding support or at least the base plate of the holding support may be produced from an aluminium material or alloy, a plastic material, and/or a composite material. Because of this the holding support may be provided cost-effectively and in large quantities. In the event that the holding support and/or the base plate are produced from an aluminium material or alloy, the mounting of the holding support to a v-shaped heat exchanger may be realised by means of soldering.

According to another aspect of the present disclosure, a v-shaped heat exchanger having at least two holding supports according to the above description is provided. To this end, an altogether v-shaped heat exchanger with a first fluid collector and a second fluid collector is provided, which by way of flat tubes are fluidically coupled to one another, so that fluid can flow from a first fluid collector to the second fluid collector or vice versa. Furthermore, the v-shaped heat exchanger has at least two holding supports according to the preceding description and a collecting pan for collecting condensate. Here, the flat tubes comprise two straight flat tube portions and a bent flat tube portion that is fluidically arranged between the two straight flat tube portions. Between adjacent flat tubes of the one straight flat tube portion, cooling fins are arranged that allow for the circulation of cooling air. These cooling fins may be configured in a zigzag-shape. Likewise, similar cooling fins may be arranged between adjacent flat tubes of the other straight flat tube portion. Merely the bent flat tube portion does not have any cooling fins, i.e. is cooling fin-free.

Furthermore, it is provided that the holding supports with the spreading finger holders are arranged on two outer large sides of the v-shaped heat exchanger that are oriented opposite to one another and inclined relative to one another so that their first holding fingers are each inserted on a bent flat tube portion between two adjacent flat tubes and their second holding fingers are each touchingly supported on the bent flat tube portion and/or on one of the two straight flat tube portions on the flat tubes. In order to join the holding supports with the flat tubes the first holding fingers and the second holding fingers of the two holding supports may be integrally bonded by soldering or positively and/or non-positively fixed to the flat tubes. for example, by means of fastening screws or clamps. The integral unit thereby formed out of the flat tubes, the two fluid collectors and the two holding supports is exclusively supported on the collecting pan by way of the two holding supports. Because of this, the v-shaped heat exchanger can be relatively easily placed onto the collecting pan. In addition it can be ensured that merely the support of the holding support but not the v-shaped heat exchanger itself comes into contact with the collecting pan. This has the advantage that moisture and dirt collected by the collecting pan does not come into contact with the bent flat tube portion of the v-shaped heat exchanger, so that signs of corrosion and dirt build-up on the bent flat tube portion of the v-shaped heat exchanger can be efficiently prevented.

According to another aspect of the present disclosure, a carbon coating or a carbon layer may be arranged between the base plate at least one holding support and the bent flat tube portion. The use of this carbon coating or layer prevents the formation of an unintentional integrally bonded connection of a base plate with the bent flat tube portion when the holding supports are soldered onto the bent flat tube portion.

The condensate that condenses on the v-shaped heat exchanger and is susceptible to dripping off the bent flat tube portion, can now drain via the holding supports, e.g., via the holding fingers, into the collecting pan so that the bent flat tube portion is exposed to even less moisture and condensate.

According to another aspect of the present disclosure, a production method for a v-shaped heat exchanger having two holding supports according to the preceding description is provided. To this end, a plane flat tube blank with two straight flat tube portions comprising cooling fins and a flat tube portion that is not bent and cooling fin-free arranged between the two straight flat tube portions and two separate holding supports are provided. Then, the holding supports are loosely placed onto a large side of the provided flat tube blank and soldered to the flat tube blank. Here, specified portions of the flat tube blank and/or of the holding supports can be provided with a carbon coating or a carbon layer in order to avoid a soldered connection on these portions. Following this, the flat tube portion that is not bent in the flat tube blank and the holding supports are bent over so that a bent flat tube portion results in a v-shaped contour of the heat exchanger.

One skilled in the art will understand that within the scope of the production method the two holding supports may be initially loosely placed onto the flat tube blank, wherein the holding supports with their spreading finger holders are inserted on flat tubes of the flat tube portion of the flat tube blank that is not bent and are thus held. In this case, at least one holding support having at least one mounting tab is supported on the respectively other holding support. In this manner, an accurate and secure positioning of the holding supports on the flat tube blank is thereby possible.

Within this specification, embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein. It is to be understood that the features mentioned above and still to be explained in the following cannot only be used in the respective combination stated but also in other combinations or by themselves without leaving the scope of the present invention.

Figure 2:
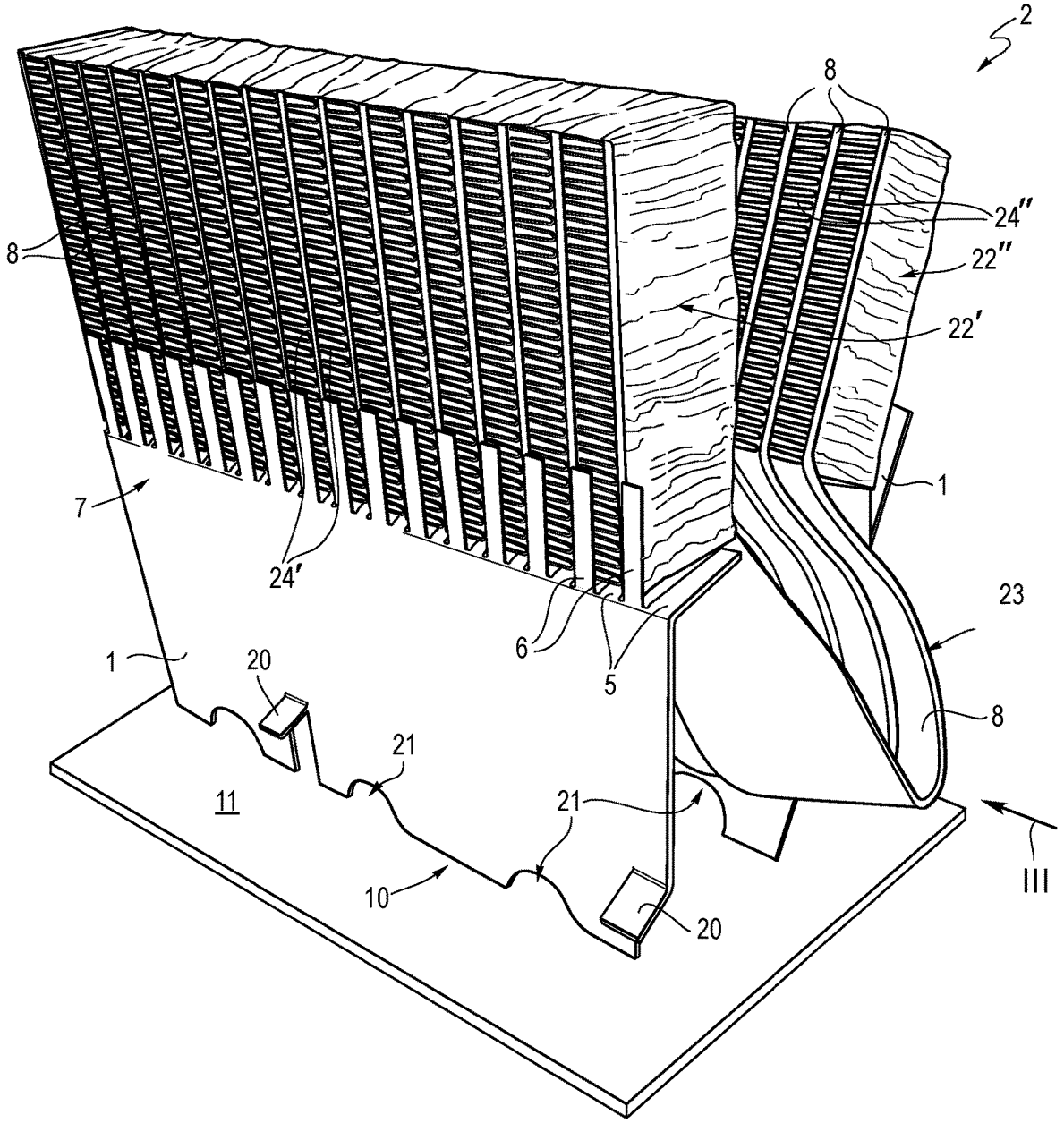
FIG. 2 is a perspective view of a v-shaped heat exchanger equipped with two holding supports according to teachings of the present disclosure.
Figure 3:
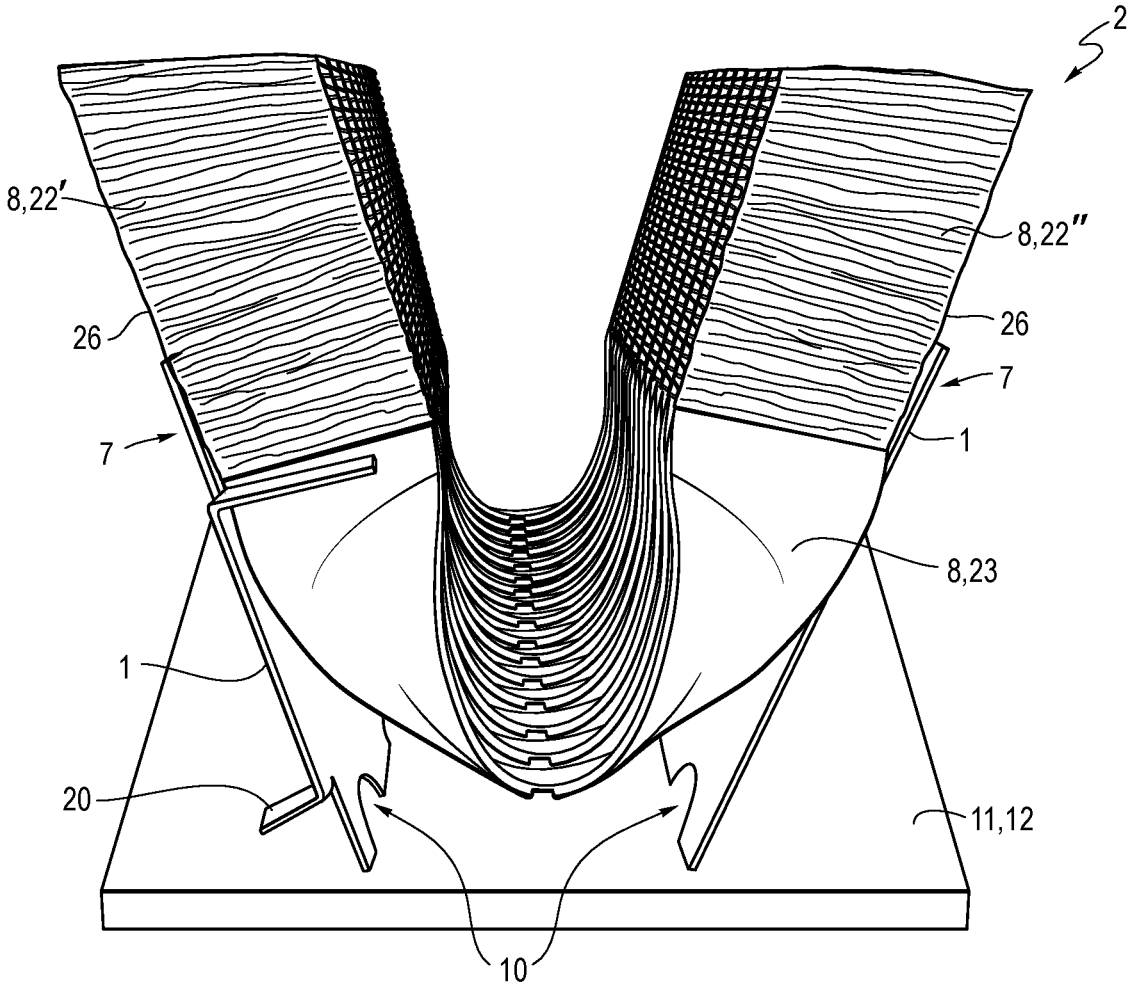
FIG. 3 is the v-shaped heat exchanger from FIG. 2, in which the viewing direction is from the front according to arrow III shown in FIG. 2.

Referring now to FIGS. 1 to 3 exemplary embodiments for a holding support are provided and marked as a whole with the reference number 1 for use in a v-shaped heat exchanger 2. In FIG. 1 a perspective view of a holding support 1 formed according to the teachings of the present disclosure is provided. The holding support 1 comprises an approximately rectangular, flat base plate 3, which is produced from aluminium and on a straight plate edge 4 comprises a spreading finger holder 7 for holding flat tubes 8 of a v-shaped heat exchanger 2, as is illustrated for example in FIGS. 2 and 3. Furthermore, the base plate 3 has, on a side of the base plate 3 that is opposite to the plate edge 4, a further straight plate edge 9, which forms or comprises a support 10. Referring now to FIGS. 2 and 3, the holding support 1 is supported on a surface 11, such as on a collecting pan 12 equipped for collecting and conducting condensate of the v-shaped heat exchanger 2, with the support 10.

Still referring to FIGS. 1-3, the spreading finger holders 7 are exemplary realised out of multiple holding fingers 5, 6 integrally arranged on the base plate 3, wherein first holding fingers 5 are each bent over with respect to the base plate 3 at a folding region 13 of the plate edge 4, while second holding fingers 6 are embodied flat with respect to the base plate 3. This means that the first holding fingers 5 with respect to the base plate 3 or with respect to a base plane 14 defined by the base plate 3 are inclined while the second holding fingers 6 lie completely in the base plane 14. The base plane 14 is indicated in FIG. 1 by a simple, dashed frame. Exemplarily, a 90° angle 16 is thereby defined in each case between a first holding finger 5 and a second holding finger 6 (or all first holding fingers 5 and all second holding fingers 6). By way of this, the first holding fingers 5 and the second holding fingers 6 define a mounting receptacle 15 for receiving flat tubes 8 of the v-shaped heat exchanger 2. One skilled in the art will understand that 90° is described in the figures as one specific example and that the angle may differ therefrom without exceeding the scope of the present disclosure. With respect to the holding fingers 5, 6 it still needs to be explained that they may be arranged along the plate edge 4 in series with one another, evenly distributed over the entire length of the plate edge 4 and arranged in an alternating order, so that in a plate direction 17 defined by the plate edge 4 first holding fingers 5 and second holding fingers 6 always alternate.

Referring once again to FIG. 1, it is shown that in the plate direction 17 between a first holding finger 5 and a second holding finger 6 a rather small production-related gap 18, for example a cutting gap, may be present. Furthermore it is provided that in each case two first holding fingers 5 are adjacent to the plate direction 17 via a receiving gap 27 that is wider than the gap 18 and practically formed or opened by the bending-over of a second holding finger 6 arranged between the first holding fingers 5. The receiving gap 27 serves for receiving a flat tube 8 of the v-shaped heat exchanger 2. In addition, it is noticeable in FIG. 1 that the holding fingers 5, 6 each project away from the base plate 3 in a direction of a finger direction 19 standing perpendicularly on the plate direction 17. When desirable, the holding support 1 as shown in FIG. 1 may comprise two adjacent mounting tabs 20 each projecting away from the base plate 1 and have three drainage recesses 21 which are arranged in the region of the further plate edge 9 and each open out at the same, i.e. are configured open.

Referring now to FIGS. 2 and 3, each figure shows in a perspective view a v-shaped heat exchanger 2 according to the present disclosure, which is equipped with two holding supports 1 according to the preceding description. The v-shaped heat exchanger 2 may comprise a first head-side fluid collector, which is not illustrated here, and a second head-side fluid collector, which also is not illustrated here. The first and second head-side fluid collectors may be fluidically coupled to one another via flat tubes 8 so that fluid from the first fluid collector can flow to the second fluid collector or vice versa. The v-shaped heat exchanger 2, furthermore, comprises two holding supports 1 according to the preceding description and a collecting pan 12 forming a surface 11 for collecting condensate.

In FIGS. 2 and 3 it is noticeable that the flat tubes 8 are produced in one piece but comprise two straight flat tube portions 22', 22" and a bent flat tube portion 23 fluidically arranged between the two straight flat tube portions 22', 22". Between adjacent flat tubes 8 of the one straight flat tube portion 22', cooling fins 24' that can be circulated about by cooling air are arranged. Between adjacent flat tubes 8 of the other straight flat tube portion 2", cooling fins 24" that can be circulated about by cooling air are also arranged. The bent flat tube portion 23 does not have any cooling fins, i.e. is configured cooling fin-free. The two holding supports 1 are arranged with their spreading finger holders 7 on two outer large sides 26 of the v-shaped heat exchanger that are oriented opposite to one another and inclined relative to one another so that their first holding fingers 5 in each case are inserted on the bent flat tube portion 23 between two adjacent flat tubes 8 and the second holding fingers 6 are each touchingly supported from the outside on the bent flat tube portion 23 and/or from the outside on one of the two straight flat portions 22', 22" on the flat tubes 8. Because of this, the two holding supports 1 are loosely held on the v-shaped heat exchanger 2.

In order to captively secure the two holding supports on the v-shaped heat exchanger 2, the first holding fingers 5 and the second holding fingers 6 of the two holding supports 1 may be fixed to the flat tubes 8 in an integrally bonded manner by soldering. The integral unit thereby formed out of the flat tubes 8, the two fluid collectors and the two holding supports 1 can then be subsequently supported on the collecting pan 12 via the two holding supports 1. Because of this, the v-shaped heat exchanger 2 can be relatively easily placed and mounted to the collecting pan 12. In addition it can be ensured that merely the supports 10 of the holding supports 1 but not the v-shaped heat exchanger 2 itself, in particular not the bent flat tube portion 23 of the same, comes into contact with the collecting pan 12. This has the advantage that any fluid, moisture and/or dirt situated in the collecting pan 12 does not come into contact with the bent flat tube portion 23 of the v-shaped heat exchanger 2. Thus, this region of the v-shaped heat exchanger 2 is thereby protected against corrosion and dirt build-up. In addition, condensate precipitating on the v-shaped heat exchanger 2 and which in a conventional heat exchanger dripped off via the bent flat tube portion 23, can now drain into the collecting pan 12 via the holding supports 1, e.g., via the holding fingers 5, 6, so that the bent flat tube portion 23 is exposed to even less moisture and condensate.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A v-shaped heat exchanger comprising:

a first fluid collector and a second fluid collector, which are fluidically coupled to one another via flat tubes, so that a fluid can flow from the first fluid collector to the second fluid collector and vice versa, at least two holding supports, each holding support containing a flat base plate that includes or forms on a plate edge a spreading finger holder comprising first and second holding fingers that hold flat tubes of the v-shaped heat exchanger and on a further plate edge a support that supports the holding support; wherein one or more of the holding fingers is bent over with respect to the base plate, such that at least one first holding finger is bent over with respect to the base plate at a folding region of the plate edge, while at least one second holding finger is embodied flat with respect to the base plate, and between the first holding fingers and the second holding fingers a mounting receptacle of the spreading finger holder for receiving flat tubes of a v-shaped heat exchanger is delimited or formed; and a collecting pan for collecting condensate, wherein the flat tubes comprise a first straight flat tube portion, a second straight tube portion, and a bent flat tube portion fluidically arranged between the first and second straight flat tube portions, wherein between adjacent flat tubes of the first straight flat tube portion, cooling fins configured for cooling air to be circulated about are arranged, wherein between adjacent flat tubes of the second straight flat tube portion, cooling fins configured for cooling air to be circulated about are arranged, wherein the bent flat tube portion is cooling fin-free, wherein the holding supports with their spreading finger holders are arranged on two outer large sides of the v-shaped heat exchanger that are oriented opposite to one another and inclined relative to one another so that their first holding fingers are each inserted on the bent flat tube portion between two adjacent flat tubes and their second holding fingers are each touchingly supported on the flat tubes on the bent flat tube portion and/or on one of the first or second straight flat tube portions, wherein the first holding fingers and the second holding fingers of the two holding supports are soldered in an integrally bonded manner or fixed by fastening screws or clamps to the flat tubes, wherein an unit formed out of the flat tubes, the two fluid collectors and the two holding supports is exclusively supported on the collecting pan by way of the two holding supports.

2. The v-shaped heat exchanger according to claim 1, wherein at least one first holding finger and at least one second holding finger define a 45° to 120° angle between them.

3. The v-shaped heat exchanger according to claim 1, wherein at least one first holding finger and at least one second holding finger are arranged along the plate edge in series with one another.

4. The v-shaped heat exchanger according to claim 1, wherein the first holding fingers and the second holding fingers are arranged along the plate edge in an alternating order.

5. The v-shaped heat exchanger according to claim 1, wherein at least one first holding finger and at least one second holding finger on or in the region of the plate edge of the base plate are directly adjacent in a plate direction defined by the plate edge with respect to one another or subject to the interposing of a gap, and/or two first holding fingers are adjacent in a plate direction defined by the plate edge subject to the interposing of a receiving gap.

6. The v-shaped heat exchanger according to claim 1, wherein at least one first holding finger and at least one second holding finger each project away from the base plate in the direction of a finger direction perpendicular to a plane defined by the plate edge.

7. The v-shaped heat exchanger according to claim 1, wherein at least one first holding finger and at least one second holding finger are integrally formed with the base plate.

8. The v-shaped heat exchanger according to claim 1, wherein at least one first holding finger is embodied identical in length or shorter than at least one second holding finger.

9. The v-shaped heat exchanger according to claim 1, wherein the one plate edge and the further plate edge are arranged on sides of the base plate that are opposite to one another and/or are configured parallel to one another, and/or the support is realized by a base plate narrow surface of the base plate defined by the further plate edge.

10. The v-shaped heat exchanger according to claim 1, wherein on the base plate at least one mounting tab is arranged, which is equipped for supporting a further holding support and bent over with respect to the base plate.

11. The v-shaped heat exchanger according to claim 1, wherein on the base plate at least one drainage recess is arranged.

12. The v-shaped heat exchanger according to claim 1, wherein at least the base plate is produced out of an aluminium material, a plastic material, a composite material, or a combination thereof.

* * * * *